United States Patent [19]

Hofbauer et al.

[11] 4,296,716

[45] Oct. 27, 1981

[54] INTERNAL COMBUSTION ENGINE FOR AN AUTOMOBILE WITH A DIVIDED OIL PAN

[75] Inventors: Peter Hofbauer; Michael Willmann; Egon Wundrak, all of Wolfsburg, Fed. Rep. of Germany

[73] Assignee: Volkswagenwerk Aktiengesellschaft, Wolfsburg, Fed. Rep. of Germany

[21] Appl. No.: 44,050

[22] Filed: May 31, 1979

[30] Foreign Application Priority Data

Jun. 3, 1978 [DE] Fed. Rep. of Germany ..... 2824415

[51] Int. Cl.[3] ..... F01M 11/06

[52] U.S. Cl. ..... 123/195 C; 123/196 AB; 184/6.5; 184/106

[58] Field of Search ..... 123/195 R, 195 C, 179 M, 123/196 AB; 180/69.1; 184/6.5, 106

[56] References Cited

U.S. PATENT DOCUMENTS

| | | | |
|---|---|---|---|
| 1,278,655 | 9/1918 | Holliday | 184/6.5 |
| 1,920,012 | 7/1933 | Good | 123/196 AB |
| 2,577,188 | 12/1951 | Hall | 184/106 |
| 3,521,613 | 7/1970 | Celli | 123/195 R |
| 3,590,953 | 7/1971 | Wellauer | 184/106 |
| 3,638,760 | 1/1972 | Lamm | 184/106 |
| 3,653,464 | 4/1972 | Jacobsen et al. | 184/6.5 |
| 3,695,386 | 10/1972 | Thien et al. | 123/195 C |
| 3,724,599 | 4/1973 | Heibacker | 123/195 C |
| 4,134,380 | 1/1979 | Niwa et al. | 184/6.5 |

FOREIGN PATENT DOCUMENTS

| | | |
|---|---|---|
| 683901 | 11/1939 | Fed. Rep. of Germany . |
| 2057625 | 5/1972 | Fed. Rep. of Germany . |

*Primary Examiner*—Craig R. Feinberg

*Attorney, Agent, or Firm*—Brumbaugh, Graves, Donohue & Raymond

[57] ABSTRACT

An internal combustion engine has an oil pan divided into two chambers that communicate with each other. The first chamber is at a distance above the bottom of the oil pan, which is also the bottom of the second chamber. Because the bottom of the oil pan is cooled by the slip stream the oil in the two chambers are at different temperatures. Suction lines lead from each chamber to a thermostat valve that connects them to a discharge line. The thermostat valve operates such that when the engine is cold the oil supplied to the discharge line is relatively hot oil from the first chamber and when the engine is hot the relatively cool oil from the second chamber is supplied via the valve.

12 Claims, 3 Drawing Figures

INTERNAL COMBUSTION ENGINE FOR AN AUTOMOBILE WITH A DIVIDED OIL PAN

BACKGROUND OF THE INVENTION

The present invention relates to internal combustion engines and, more particularly, to devices for supplying oil of different temperatures to such engines.

It is known that the process of supplying an internal combustion engine with lubricating oil suffers from the problem that during normal automotive operation, particularly during the hot summer season, cooling of the lubricating oil is necessary, while during the starting of the engine and when it is operating in the partial load range, particularly during the cold winter season, the oil temperature is not at an optimal value. Therefore, various measures have become known which aim at optimizing the oil temperature. Apart from immersion heater-like heating devices for the oil, which heaters strain the battery in an undesirable manner, devices for automatic control of oil cooling have become known from German Pat. No. 683,901. These devices contain a thermostatically controlled valve which at higher oil temperatures causes oil circulation over an additional oil cooler, but short circuits the oil cooler at lower oil temperatures. A shortcoming of devices of this kind may be seen in the need for an oil cooler which must be connected by way of lines with the oil pan and the valve arranged therein.

German patent application No. M 10 525, discloses an internal combustion engine with an oil pan divided into two sections so that two oil quantities of different temperatures are available. The two chambers communicate with each other and are equipped with suction lines. The bottom of one of the chambers is located at a distance above the bottom of the oil pan. From the two chambers in the oil pan, oil having different temperatures is sucked up by means of separate pumps through separate coolers arranged outside the oil pan. The oil is used partly for piston cooling and partly to supply points in the internal combustion engine with lubrication. In this case, the aim is to obtain, during all operating phases of the internal combustion engine, and thus independent of the prevailing oil temperature resulting from the temperature of the internal combustion engine, two oil circulations with different oil temperatures, i.e., partly for cooling and partly for lubricating.

German Letters of Disclosure No. 2 057 625 also show a reciprocating piston engine with a divided oil pan. However, this construction is suitable only for a stationary machine in that in this specific case, an especially large lubricating oil storage tank is assumed, which tank extends below the internal combustion engine and a current generator driven by the engine. The oil pan is divided into two quite differently sized chambers by means of a perpendicular wall. The extraction of the oil from the pan is obtained through suction lines which in each case are associated with one of the chambers and which, by way of a thermostat valve, pass into a common delivery line. The principle of this known stationary internal combustion engine with regard to an upward limitation of the oil temperature, thus consists in providing a sufficiently large oil volume, and not in creating a device in the manner of an oil cooler. This limitation on the oil temperature also does not involve rendering the design of the internal combustion engine within the limits of the oil pan in such a manner that the necessary cooling is ensured without an investment in an additional oil cooler.

Ribbing of the bottom of an oil pan to cool the oil is known from U.S. Pat. No. 3,521,613. In addition, a mechanical vibration-insulating mounting of an oil pan is described in U.S. Pat. No. 3,695,386.

SUMMARY OF THE INVENTION

The purpose of the present invention is to create an internal combustion engine for an automobile in such a manner that the temperature of the oil drawn from the oil pan is in a favorable range, whereby the effort and expense of additional oil coolers are avoided. The attainment of this purpose in accordance with the invention is distinguished by providing an oil pan with two chambers that communicate with each other. The bottom of one chamber is located at a distance above the bottom of the other, which is the bottom of the oil pan. By locating the bottom of the oil pan in the slip stream, the oil in the lower chamber is cooled. Each chamber is provided with suction lines connected to a common delivery line via a thermostat valve. The thermostat valve supplies either hot or cool oil depending on the necessary requirements.

Thus, in accordance with the invention, the oil pan is arranged in such a manner and the two chambers within the oil pan have such a relative position that one chamber serves to obtain an oil quantity which rapidly warms up when the internal combustion engine is cold and whose temperature drops only slightly on transition to part load operation, whereas the other chamber serves as an oil cooler.

BRIEF DESCRIPTION OF THE DRAWINGS

In the following detailed description, two examples of embodiments of the invention will be described with reference to the drawings in which.

DESCRIPTION OF PREFERRED EMBODIMENTS

Figure 1:
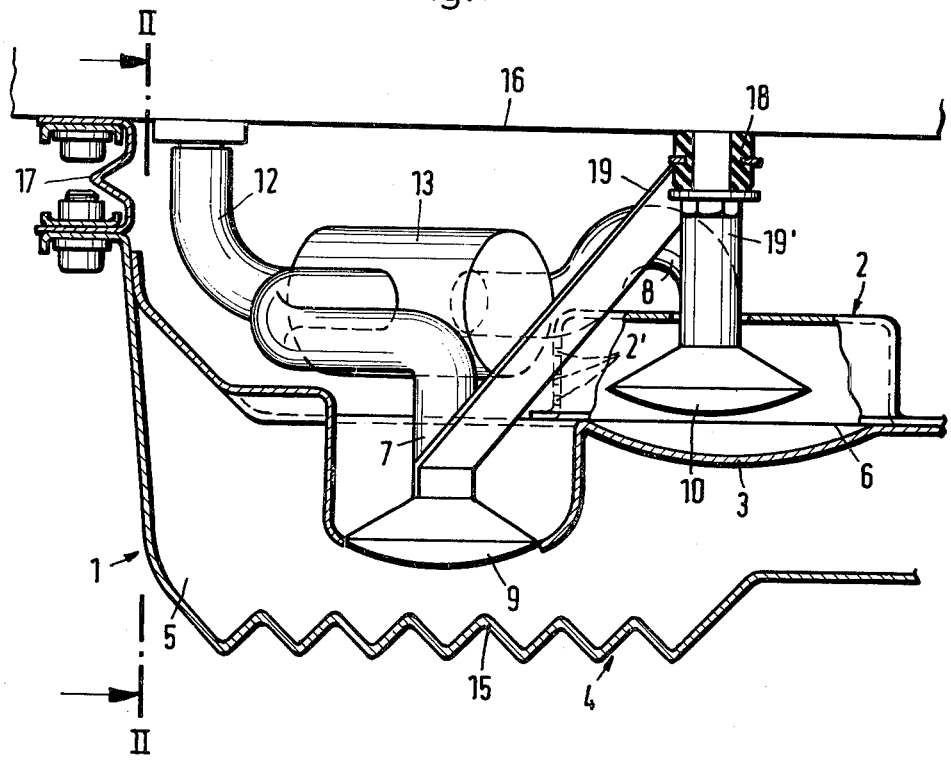
FIG. 1 represents a front view of the oil pan of an engine, that extends transversely in the vehicle, with the front wall of the pan removed.
Figure 2:
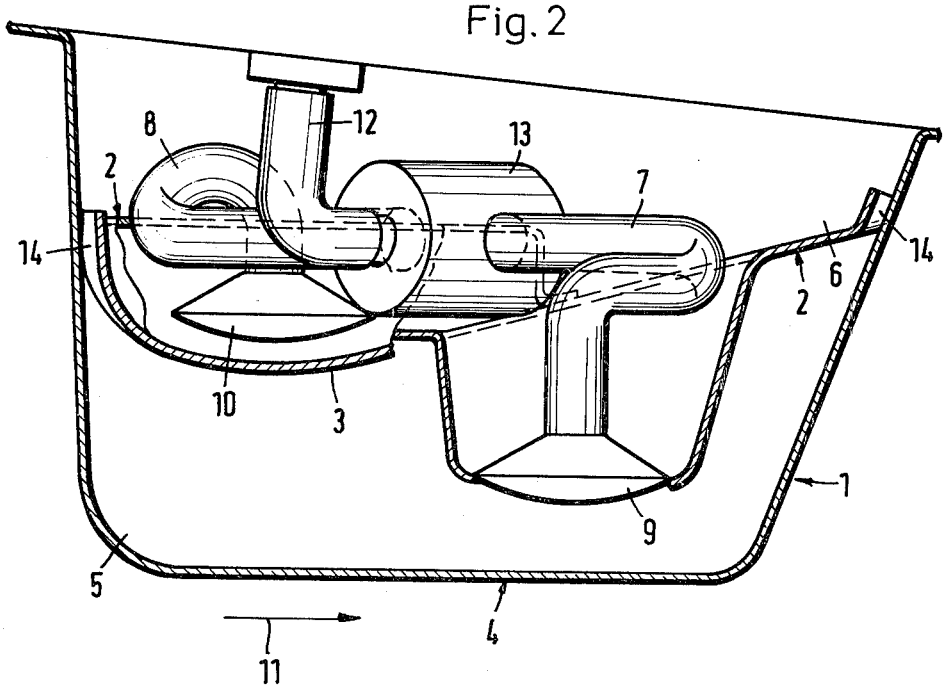
FIG. 2 represents the section designated by II—II in FIG. 1.

FIGS. 1 and 2 show an oil pan 1 divided into two oil chambers, 5 and 6 by an accumulation housing 2 that is arranged in the pan. The bottom 3 of the housing is placed at a predetermined distance from the bottom 4 of the oil pan 1. The upper portion of the housing 2 is in communication by way of openings 2' with the region of the first chamber 6 that appears to the left in FIG. 1 and which extends above the second chamber 5. The bottom 3 is suitably rendered in a heat-insulating manner, e.g., as a double bottom or as a laminated or coated bottom.

Suction lines 7 and 8 project, respectively, into the two chambers 5 and 6. The open ends of the suction lines are provided with oil strainers 9 and 10, respectively, in a manner known per se. The suction line 7, which is associated with the second chamber 5, ends in the region of the chamber 5 which is toward the front in the driving direction (arrow 11 of FIG. 2). Even if the oil volume in the second chamber 5 is not as large as the volume in the first chamber 6, this arrangement ensures that due to the flow of the slip stream, the oil in the front region of the oil pan 1, i.e., at the point where the suction line 7 enters, is better cooled than in the rear region. Accordingly, the oil sucked in by the suction line 7 is relatively cool compared to the oil in chamber 6 and is delivered to the internal combustion engine proper by means of a delivery line 12 connected with a supply pump, not shown. However, when the temperature of the oil is relatively low, the oil is sucked out of the first chamber 6, whose bottom is well insulated towards the outside so that an oil circulation is obtained which is relatively warm.

Between the outer ends of the suction lines 7 and 8 and the ends of the supply line 12 facing them, there is arranged a thermostat valve 13 which has a known design and thus is not described. When the engine is cold, it connects the suction line 8 with the supply line 12 and when the engine is warm, it connects the suction line 7 with the supply line 12. Obviously, the thermostat valve 13 may be designed in a manner whereby the control also takes into account transition temperatures between the temperature values which would lead to the exclusive supply of oil from only one of the chambers 5 or 6.

In FIG. 2 we observe that communication openings 14 between the chambers 5 and 6 are provided only in the vicinity of the side walls of the oil pan 1 so that the oil, during its conveyance from the smaller chamber 6 and the larger chamber 5, flows along the walls of the oil pan and is cooled. Moreover, the communication openings 14 are rendered in such a manner that an easy follow-up delivery of oil from the first chamber 6 into the second chamber 5, to the necessary extent, becomes possible if oil is sucked, at least predominately, from the second chamber 5 when the internal combustion engine is hot. However, upon delivery of oil, at least predominately, from the first chamber 6 when the internal combustion is cold, the openings 14 are designed so that the oil exchange is as limited as possible. Thus, to the extent to which lines need to be run through the housing 2 of the smaller chamber 6, it is advisable to seal off any gaps that may possibly be created by means of elastic seals so as to keep the oils of different temperatures from mixing.

In order to attain the best possible cooling by the slip stream alone, without the need for an additional oil cooler, the bottom region 4 of the oil pan 1 may be provided with ribs or corrugations 15, e.g., in the manner of corrugated steel, extending in the direction of travel. Moreover, the material used for the oil pan should be such as to ensure good heat transmission and thus should be a heat exchanger material, e.g., aluminum.

All components of the internal combustion engine described are fastened to the crankcase 16 thereof in a mechanical vibration-insulating manner by way of elastic elements 17 and 18. Toward such end, the delivery line 12 is likewise produced from elastic material. As is apparent in FIG. 1, braces 19 and 19', which serve as mounting supports for the strainers 9 and 10, are likewise maintained elastically, namely, by means of the profiled rubber element 18 on the crankcase 16.

Figure 3:
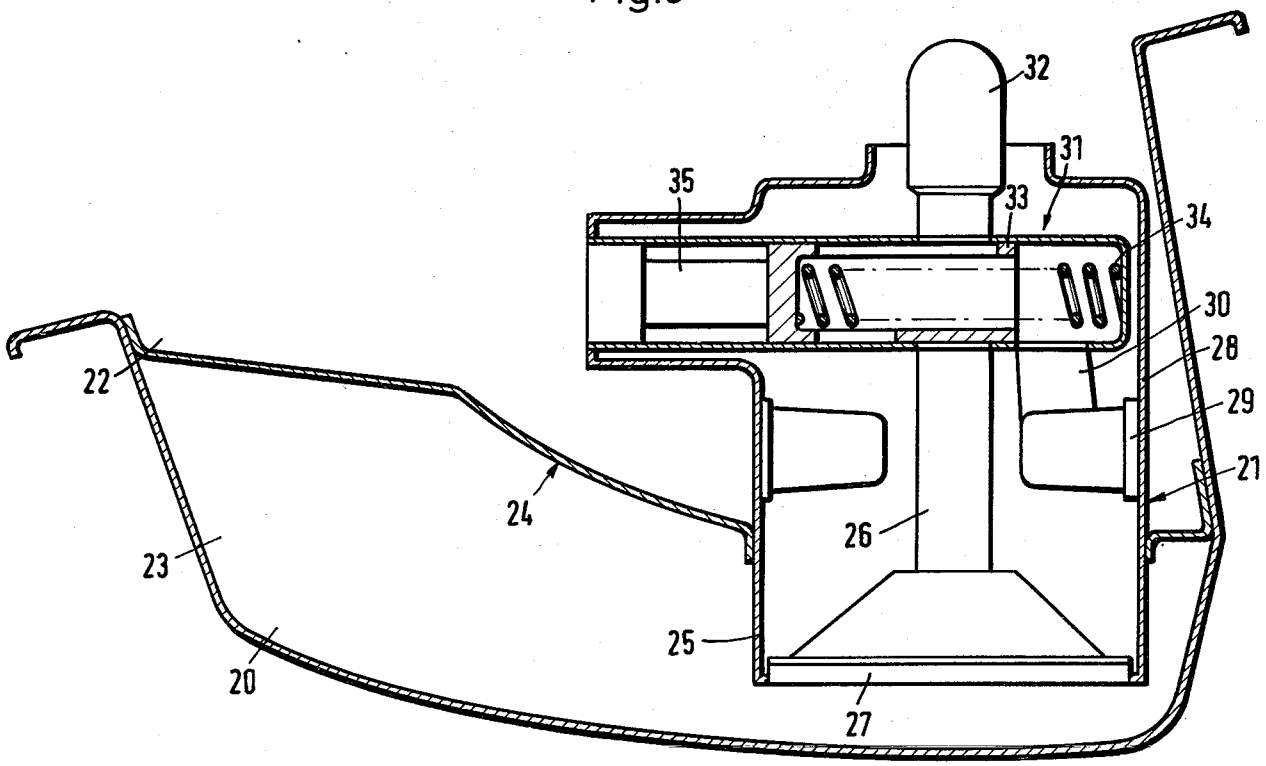
FIG. 3 shows a side view of another embodiment.

Viewing the example of an embodiment as per FIG. 3, it can be seen that the oil pan 20 is again divided into two oil chambers 22 and 23 by a housing generally designated as 21. Oil is taken from the first chamber 22 when the internal combustion engine is cold, whereas oil is taken from the second chamber 23, when the internal combustion engine is warm. In this example of an embodiment of the invention, the housing 21 includes, as essential components, a bottom 24 into which is set an elongated housing 28. The lowest region 25 of housing 28 has a pot shape which extends relatively far towards the bottom of the oil pan 20 and into which is set an oil strainer 27 connected with a suction line 26 for the second chamber 23. Thus, the suction line 26 extends within the pot-shaped region 25 as well as the rest of the elongated housing 28, which in this case is designed as a closed housing. Into the jacket surface of the housing 28 is inserted a ring oil strainer 29 which connects the region to the left of the first oil chamber 22 in FIG. 3 with a suction line 30 associated with it.

The suction lines 26 and 30, depending on the oil temperature, are connected over a thermostat valve 31 with a delivery line 32 leading to a supply pump, not shown. In this example of an embodiment of the invention, the thermostat valve contains, as an essential component, a piston valve 33 which is displaced by the thermostat 35 in opposition to the action of a spring 34. The displacement of piston 33 is controlled as a function of the temperature in such a manner that it selectively connects one of the suction lines, 26 and 30, completely with the supply line 32 or produces a part connection of the two suction lines with the supply line.

Thus, in this example, all of the components of the invention which serve for the drawing off of the oil are located in the housing 28. This housing serves to ensure a sufficient oil volume during cornering and when the internal combustion engine is cold.

While the invention has been particularly shown and described with reference to a preferred embodiment thereof, it will be understood by those skilled in the art that various changes in form and details may be made therein without departing from the spirit and scope of the invention.

We claim:

1. An internal combustion engine for an automobile with an oil pan divided into two chambers from which two lubricating oil quantities having different temperatures are obtained, the two chambers are in communication with each other and are equipped with suction lines, the bottom of a first one of said chambers being placed at a distance above the bottom of the oil pan, which is also the bottom of the second one of said chambers, characterized in that at least the bottom region of the oil pan is exposed to the slip stream of the automobile and is designed in a heat-transmitting manner; and a suction line from each chamber opens into a common delivery line by way of a thermostat valve, said thermostat valve forms a connection means wherein at low oil temperatures, at least predominantly, effects communication of the delivery line only with the first of the chambers and at oil temperatures above a preselected level, at least predominantly, effects communication of the delivery line only with the second chamber instead of the first.

2. An internal combustion engine as in claim 1, characterized in that the oil pan, thermostat valve and the suction lines are maintained by way of elastic support means on other parts of the engine for providing mechanical vibration insulation.

3. An internal combustion engine as in claim 1, characterized in that the bottom region is provided with a rib-like profile.

4. An internal combustion engine as in claims 1 or 3, characterized in that the suction line of the second chamber ends in a zone of the second chamber which is a front zone in the direction of travel of the automobile.

5. An internal combustion engine as in claim 1 or 3, characterized in that the bottom of the first chamber is rendered so as to be heat insulated.

6. An internal combustion engine as in claim 1 or 3, characterized in that the bottom region is made of a heat exchanger material.

7. An internal combustion engine as in claim 6 characterized in that the heat exchanger material is aluminum.

8. An internal combustion engine as in claims 1 or 3, characterized in that the first chamber is formed by a housing with communication openings to the second chamber, which openings are dimensioned and arranged in such a manner that when oil is sucked up from the second chamber, only the required replacement oil quantity can flow from the first chamber.

9. An internal combustion engine as in claim 8, characterized in that the communication openings are placed in the vicinity of walls of the oil pan so that the oil flows along these walls.

10. An internal combustion engine as in claim 8, characterized in that the bottom of the first chamber is provided with a lowest region having a pot shape, into which region is set an oil strainer for the suction line that opens into the second chamber, which suction line extends within the first chamber.

11. An internal combustion engine as in claim 10, characterized in that the pot-shaped region is part of an elongated housing extending upwardly from the pot-shaped region, said housing carrying a ring oil strainer for the suction line associated with the first chamber.

12. An internal combustion engine in accordance with claim 11, characterized in that the housing is enclosed and contains the thermostat valve.

* * * * *

UNITED STATES PATENT AND TRADEMARK OFFICE

CERTIFICATE OF CORRECTION

PATENT NO. : 4,296,716

DATED : October 27, 1981

INVENTOR(S) : Hofbauer et al.

It is certified that error appears in the above—identified patent and that said Letters Patent is hereby corrected as shown below:

Column 1, line 31, after "M 10 525," insert --4601.2--;
Column 1, line 49, after "625" insert --F01m, 5/00--;
Column 4, line 52, "wherein" should read --which--.

Signed and Sealed this

*Twenty-third* Day of *February 1982*

[SEAL]

*Attest:*

GERALD J. MOSSINGHOFF

*Attesting Officer*

*Commissioner of Patents and Trademarks*